US005711039A

United States Patent [19]

Mizrahi

[11] Patent Number: 5,711,039

[45] Date of Patent: Jan. 27, 1998

[54] DUAL POWER-FLUSH TOILET

[76] Inventor: Israel Mizrahi, 6614 Noble Ave., Van Nuys, Calif. 91405

[21] Appl. No.: 613,482

[22] Filed: Mar. 11, 1996

[51] Int. Cl.[6] ..... E03D 5/00

[52] U.S. Cl. ..... 4/344; 4/325; 4/353

[58] Field of Search ..... 4/343, 344, 353, 4/324, 325

[56] References Cited

FOREIGN PATENT DOCUMENTS

| | | | |
|---|---|---|---|
| 0448092 | 9/1991 | European Pat. Off. | 4/324 |
| 2415171 | 9/1979 | France | 4/353 |
| 2205531 | 8/1973 | Germany | 4/343 |
| 4303343 | 8/1994 | Germany | 4/353 |
| 0023210 | 10/1897 | United Kingdom | 4/344 |

*Primary Examiner*—Charles E. Phillips
*Attorney, Agent, or Firm*—Albert O. Cota

[57] ABSTRACT

A dual power-flush toilet (20) which has a water closet (22), a water tank (24), a ball cock (26), and a first lever arm (28). A dual acting flush valve (30) is disposed within the tank and modified to incorporate an overflow opening (44), a refill elbow (46) and a beveled washer (32). A second tank lever arm (50) is installed into the tank and lifts the flush valves vertical tube (36) causing a partial flush of the water in the tank. The first tank lever arm is attached to the flush valves float assist arm (38) beneath the second lever arm lifting both the vertical tube and float assist (40) delaying the opening until a complete flush of the water from the tank is achieved. A pressure increasing riser (56) is added between the water closet and the water tank to boost the water pressure and more efficiently flush water from the tank into the water closet.

11 Claims, 3 Drawing Sheets

DUAL POWER-FLUSH TOILET

TECHNICAL FIELD

The present invention relates to toilets which include water closets and tanks in general and, more specifically, to dual action flushing combinations for partial or full flushing of water from the tank into the closet.

BACKGROUND ART

The modern toilet consists of three parts, (1) a water tank which functions as a water reservoir, (2) a water closet consisting of a bowl that also contains a volume of water into which is introduced human waste products and (3) a flushing apparatus.

Once waste products have been introduced into the toilet, they are flushed by activating the flushing apparatus which allows the water held in the water tank to flow into the bowl. The waste products are flushed into a collection system, such as a sewer system or septic tank, after which the water tank and bowl are refilled in preparation for a subsequent flush.

Waste products consist of solid and liquid waste. In presently available toilets, one flush is utilized to carry away both solid and liquid waste, even for occasions when there is only liquid waste in the bowl. In these toilets, a full or partial flush is effected with each flush and the respective content of the upper tank section is drained into the bowl and then into the sewer system.

One of the most popular toilet flushing apparatuses includes a ball-cock valve assembly that controls the inlet of water into the toilet water tank. A float ball is connected to the ball-cock valve by means of a float arm. As the toilet tank fills with water, the buoyant float ball rises in the tank section, the motion being transmitted to the ball-cock through the float arm until at a predetermined water level, the ball-cock assembly shuts off the water inlet to the tank. In most toilets, the water level in the water tank may be adjusted by means of a screw set mechanism provided in the ball-cock assembly. This adjustment, however, is limited in range and requires that the tank lid be lifted to obtain access to the ball-cock. Once the water level in the tank is set, the adjustment is no longer required. The same volume of water is therefore discharged every time that the tank is flushed, regardless of the volume which may be actually required on a particular occasion in order to successfully dispose of the waste.

It is well known fact that the largest use of water in most households and in many office buildings is for flushing toilets. Because the flushing is carried out with the full capacity of the water in the water tank, the water usage is wasteful and not required. Considerable interest has been centered on reducing the water used when toilets are flushed, especially at times and in places when there is a water deficiency or periods of drought.

Several water saving methods are in current use to conserve water during the toilet flushing operation. One such method is to place a filled water bag or a solid object, such as a brick, in the water tank to displace an equivalent volume of water to thus reduce the volume of water consumed with each flushing. Another common method is to lower the float valve to allow the ball-cock valve to close at a reduced water level. These methods to conserve water in many cases are self-defeating, in that, the effectiveness of the partial flush is diminished, because it may be necessary to flush twice to effect a sanitary flush. Additionally, such methods represent a compromise in that once the volume of water is set, it is not readily adjustable.

In summary, the design of the prior art apparatuses with respect to the design of the instant invention are relatively complicated, require modification of the existing hardware and in some cases, the toilet tank itself requites modification.

A search of the prior art did not disclose any patents that read directly on the claims of the instant invention however, the following U.S. patents were considered related:

| U.S. Pat. No. | INVENTOR | ISSUED |
|---|---|---|
| 5,459,885 | Gaw | 24 October 1995 |
| 5,381,561 | Carson, III | 17 January 1995 |
| 5,261,129 | Roy | 16 November 1993 |
| 4,937,894 | Hill, et al | 3 July 1990 |

The U.S. Pat. No. 5,459,885 Gaw patent discloses a flush control mechanism for a toilet that enables the toilet to be flushed with either a long flush cycle for solid wastes or a short flush cycle for liquid wastes. The invention includes a nonbouyant flush valve that controls the duration of the flush cycle. A handle assembly is provided that is rotatably manipulative around its longitudinal axis from a set orientation to a rotated orientation. The handle assembly is also reciprocally manipulative along its longitudinal axis from an extended position to a retracted position. A first mechanism is coupled to the handle assembly and the flush valve for temporarily maintaining the flush valve in an open condition when the handle assembly is rotated into its rotated orientation. The flush valve remains open until the tank drains to a first level. A second mechanism is coupled to the handle assembly for temporarily maintaining the flush valve in an open condition when the handle assembly is manipulated into its retracted position and is rotated into its rotated orientation. The second mechanism acts to hold the flush valve open until the tank drains to a second level or empties completely.

The U.S. Pat. No. 5,381,561 Carson III patent discloses a flush system for use in a toilet having a hollow body with an upper valve port and a lower valve port on which are seated an upper valve and a lower valve. The respective valves are attached to a first connecting rod and a second connecting rod. The connecting rods are attached to respective handles which are pivoted to unseat the respective valves. Unseating the upper valve produces a full flush of the toilet using a smaller regulated amount of water and unseating the lower valve produces a full flush of the toilet using a larger regulated amount of water. The handles are collocated on the outside of a water storage tank and the stems of the handles are coaxial. A bend is formed on the second connecting rod such that when the first handle is pivoted, the bend on the second connecting rod engages the first connecting rod and both the upper valve and the lower valve are unseated by the movement of the first handle. The bend portion of the second connecting rod may be broken-away to provide independent control of the unseating of the upper valve and lower valve by the respective second handle and first handle.

The U.S. Pat. No. 5,261,129 Roy patent discloses a dual volume flushing system for flush tank toilets which comprises two flapper valves located adjacent to one another. An abutting tongue is provided between the two valves for preventing the lower valve to interfere with the action of the upper valve. A flush handle is provided to simultaneously actuate both flapper valves thus allowing the water in the flush tank to rapidly flow through the valve body in the direction of the toilet bowl. This permits a minimal amount of water to be necessary for a complete flush. The flush handle is also provided with a two system lever to separately actuate the upper flapper valve along when only liquid material needs to be flushed.

The U.S. Pat. No. 4,937,894 Hill et al patent discloses a dual-flush toilet valve assembly that allows selection of either a partial or a complete flush of a toilet water tank. The invention features a hollow valve member having both a small vent bore and a larger opening. The valve is selectively pivoted in a first or a second direction depending upon which one of two activation levers is depressed. Opening the valve allows trapped air to vent from within the hollow valve. The inflowing water eventually imparts a negative buoyancy to the valve assembly allowing it to seat in the drain valve and seal the toilet tank prior to the complete discharge of the contained water. Alternatively, opening the valve allows less air to escape and therefore, the valve does not achieve a negative buoyancy. Therefore, the entire water contents of the toilet tank is allowed to drain before the valve is sealed onto the valve seat of the drain valve.

For background purposes and as indicative of the art to which the invention is related reference may be made to the remaining cited patents:

| U.S. Pat. No. | INVENTOR | ISSUED |
|---|---|---|
| 5,450,634 | Mohrman | 19 September 1995 |
| 5,331,690 | Pourcier | 26 July 1994 |
| 5,206,960 | Hooshley et al | 4 May 1993 |
| 4,937,894 | Hill, Jr. et al | 3 July 1990 |

DISCLOSURE OF THE INVENTION

At the present time, conservation of our natural resources should have everyone's prime consideration. Water is a basic human need and in some areas of the world it is in short supply especially during specific seasons. Further, water may be expensive and often considerable amounts are wasted for sanitation purposes which includes the disposition of human wastes. The conventional methods employed domestically are the utilization of toilets that include a vitreous china water closet and a water tank directly coupled thereupon. Water is released from the tank and is flushed into the closet under sufficient pressure to clear the bowl in the closet. A ball cock valve with a float refills the tank for subsequent flushing.

A primary object of the invention is to conserve water by utilizing a dual flush toilet which limits the volume of water that is required when removing only liquid waste and yet still employs the full potential of the tank for transfer of solid waste. The selection of which method is used is simply accomplished by adding a second conventional tank lever arm at a location opposite the existing arm.

The industry is aware of the problem of water conservation and is now producing equipment that functions properly with as little as a 1.5 gallons (5.8 liters) of water per flush. It has also been found that 1.0 gallons (3.8 liters) is sufficient to completely flush liquid waste.

An important object of the invention is the use of a dual acting valve that accomplishes the task for both water quantities. A valve has been developed in Israel, by a company known as Plasson, however, its functional operation is directed to European standards and is not readily applicable to equipment presently in use in this country without some modification.

Therefore another object of this invention is to alter a currently available component to be compatible with the toilets presently in public use in the United States. The Plasson company valve utilizes dual handle and lever arms in one hole with one arm pulling up a vertical tube for limited flushing and the other for both the vertical tube and an ancillary float assist that extends the opening time until the entire water volume is depleted. Further, a water closet refill elbow must be added integral with a conventional ball cock valve, and an overflow opening must be added to meet applicable domestic codes which place the overflow level 1¼ inch (3.2 cm) below the diaphragm of the ball cock valve.

Many toilets in use abroad are flat and thin. Therefore a beveled washer must be fitted at the lower threaded end of the valve to mate with the vitreous china tanks in present use in this country.

Another object of the invention offers the application and innovative use of two separate and conventional closet tank lever arms. A simple modification to an existing tank is accomplished by drilling a hole in the tank with a readily available carbide grit hole saw and installing the second lever arm. As a result of these arms being inexpensive and the holes easy to cut, the modification is an effective and novel method of pulling up both the vertical tube and assist arm. Alternatively, the toilet tank can be initially manufactured with the lever arm holes and without the two side mounting holes which are not required with the inventive design.

Still another object of the invention is to raise the level of the water by elevating the tank. This increases the pressure of the water and also the velocity with which it enters into the closet bowl. The addition of 12 inches (30.5 cm) increases the pressure by 0.43 pounds per square inch (2.98 Kpag), which is sufficient to easily empty the bowl with only one gallon of water per flush. This riser requires an attaching plate that adapts the riser to various sizes of water closets.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
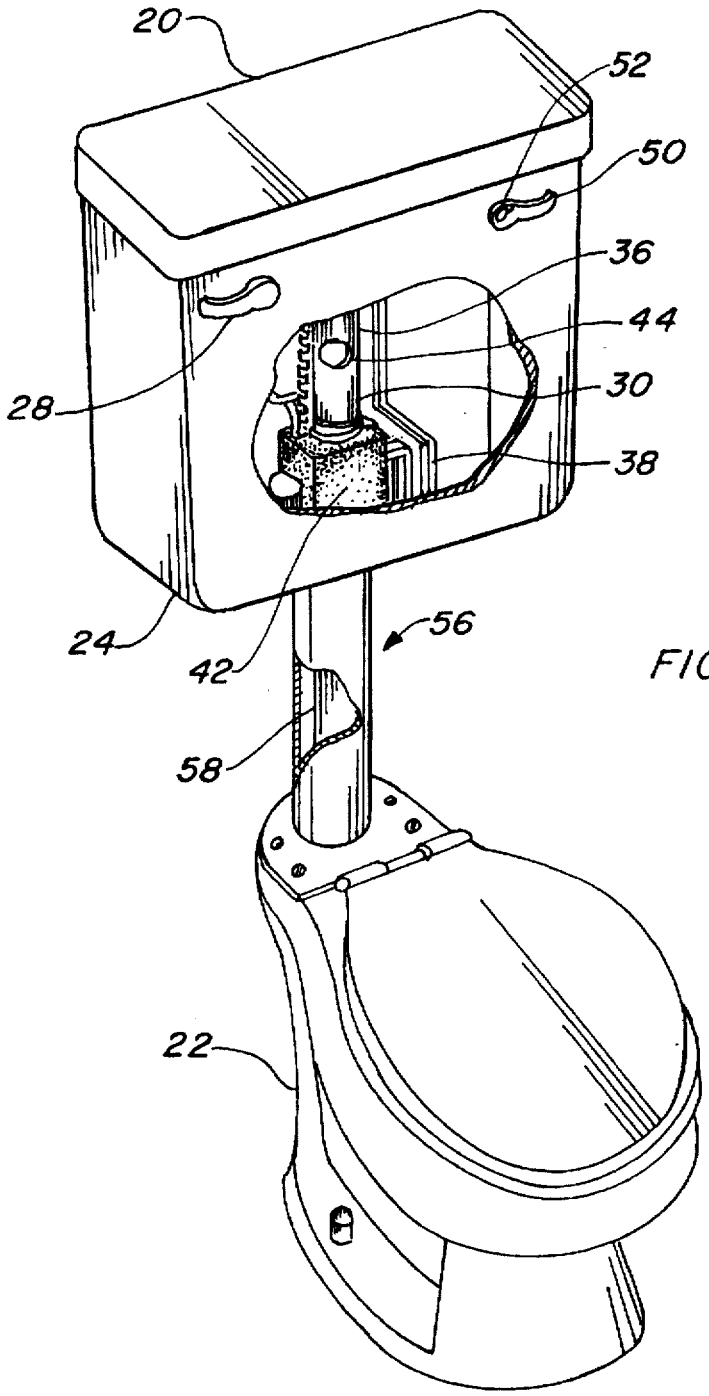
FIG. 1 is a partial isometric view of the preferred embodiment cutaway to illustrate the hollow pipe and dual acting valve inside.
Figure 2:
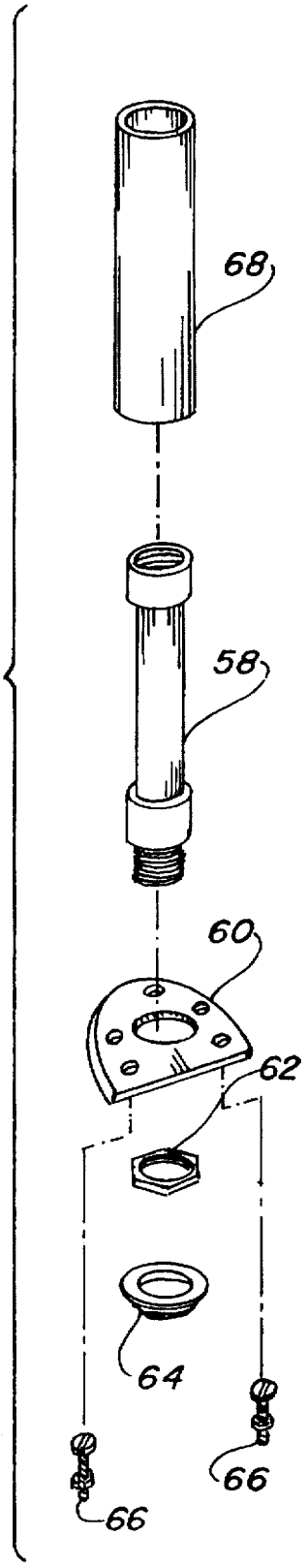
FIG. 2 is an exploded view of the pressure increasing riser.

The best mode for carrying out the invention is presented in terms of a preferred embodiment. The preferred embodiment, as shown in FIGS. 1–6 is comprised of a toilet 20 that includes a water closet 22, a water tank 24, closet tank ball cock 26 and a first tank lever arm 28, all well known in the art. The improvement to the toilet permits a dual function in the flushing procedure to economize water usage by manually selecting a flush volume of either 1.5 gallons (5.8 liters) or 1.0 gallons (5.8 liters). This ability is achieved by the utilization of a dual acting closet tank flush valve 30 in place of a conventional flapper valve or ball-type valve with guided lift wires.

Figure 3:
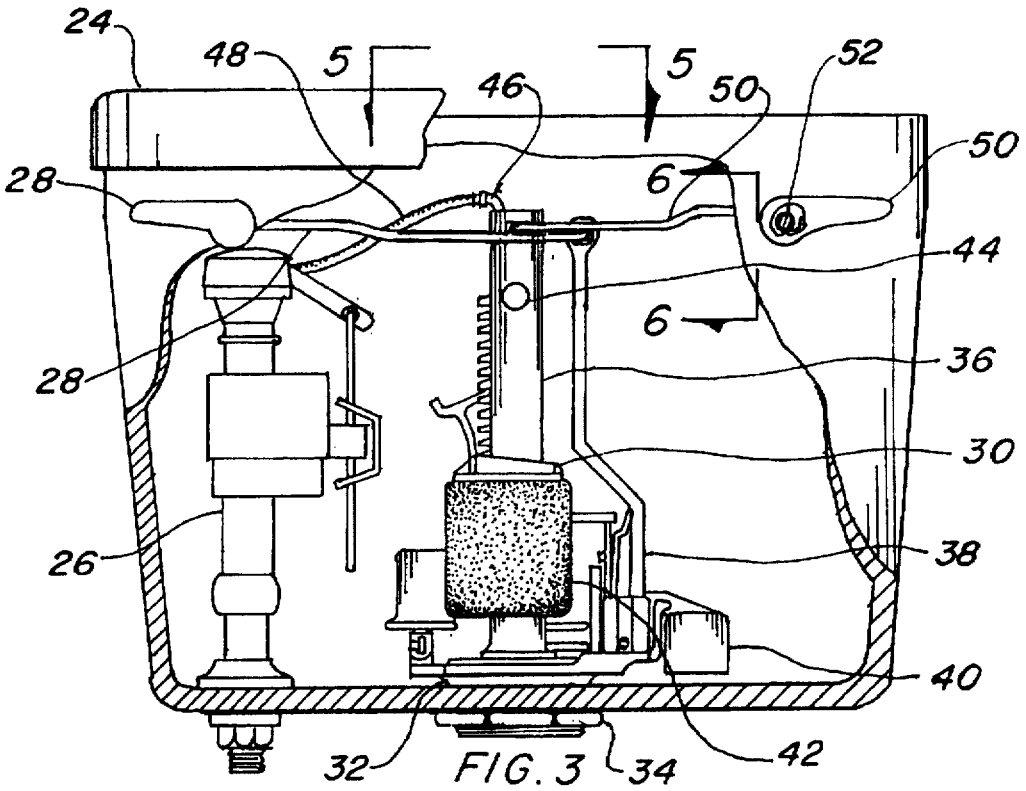
FIG. 3 is a partial isometric view of the water tank cutaway to illustrate the internal elements.
Figure 4:
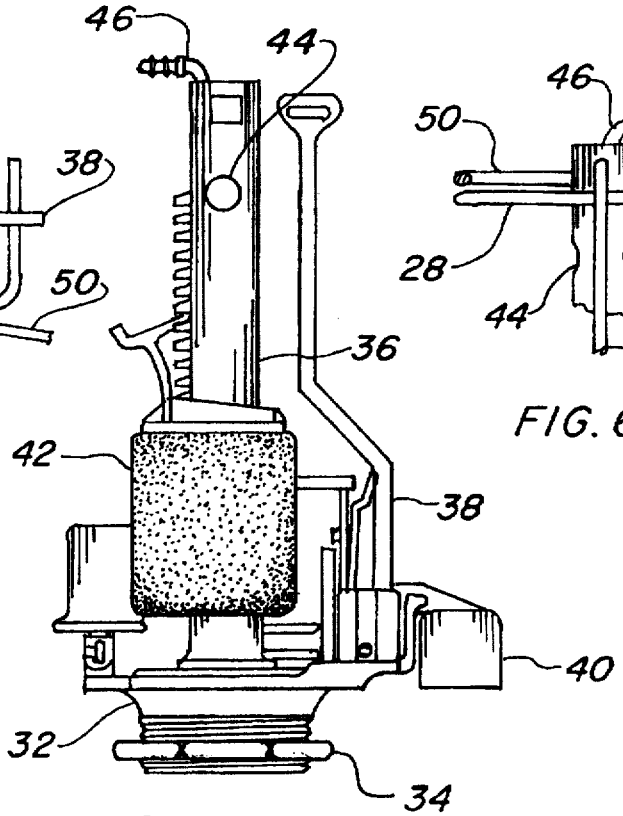
FIG. 4 is an elevational view of the dual power-flush valve completely removed from the invention for clarity.

The flush valve 30 is installed in the tank 24 in the traditional manner, using a resilient beveled washer 32 at the valve lower end and a locknut 34 for compression, as shown in FIGS. 3 and 4. The flush valve 30 is preferably constructed of a thermoplastic and manufactured in Israel, by the Plasson Company. The valve 30 includes a vertical tube 36 and an assist arm 38 linked to a float assist 40 that, when released, temporarily locks the main float 42 in place, permitting complete draining of the water within the tank 24. The vertical tube 36 is modified by adding an overflow opening 44 in the form of a hole positioned on a level 1¼ inch (3.2 cm) below the diaphragm of the ball cock 26. A water closet refill elbow 46 is attached to the vertical tube 36 at the open, upper end to permit the water closet (bowl) 22 to be refilled by the ball cock 26 using a conventional plastic hose refill tube 48. In operation, the dual acting flush valve 30 releases 1.6 gallons of water from the tank 24 when both the float assist arm 38 and vertical tube 36 are simultaneously lifted and only a partial amount of water when the vertical tube 36 is lifted independently.

Figure 5:
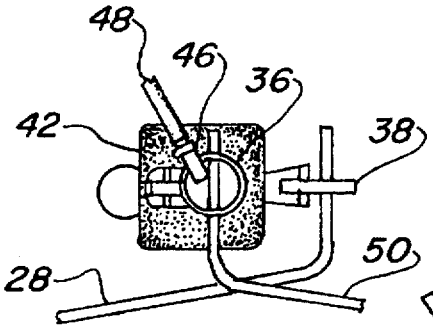
FIG. 5 is a cross-sectional view taken along lines 5—5 of FIG. 3 illustrating a top view of each lever arm attachment to the flush valve.
Figure 6:
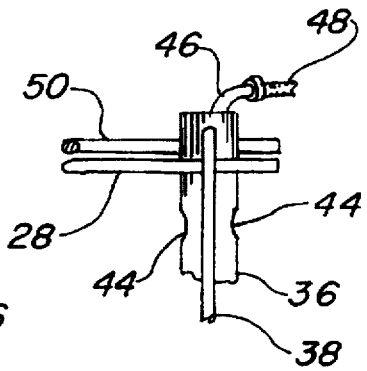
FIG. 6 is a cross-sectional view taken along lines 6—6 of FIG. 3 illustrating a side view of each lever arm attachment to the flush valve.

A second tank level arm 50 is mounted in a lever arm hole 52 drilled in the tank 24 on the right side of the tank, in line but opposite the existing first lever arm 28, as shown in FIGS. 1 and 3. The second lever arm 50 is identical to the first lever arm 28 except it is mounted on the oppoiste side of the water tank 24. If, however, the handles are concentric, the second lever arm handle may be simply reversed when installed as illustrated. In any event, the second tank lever arm 50 is bent to penetrate the existing square hole in the vertical tube 36, as depicted in FIGS. 3, 5 and 6. When the handle of the second lever arm 50 is rotated, it lifts the vertical tube 36 causing a partial flush of water within the tank 24 into the closet 22, equaling one gallon (3.8 liters).

The first tank lever arm 28 is mounted into the hole provided by the tank manufacturer which is normally located on the left side, facing the tank, as illustrated in FIGS. 1 and 3. The first lever arm 28 is bent to penetrate the opening in the flush valve float assist arm 38 and is positioned beneath the second lever arm 50 as depicted in FIGS. 3, 5 and 6. When the first lever arm 28 is manually rotated by the handle, both the float assist arm 40 and vertical tube 36 are lifted releasing the float assist arm 40 which is an air filled float that temporarily locks the vertical tube 36 in an upward position. As the vertical tube is integrally formed with the resilient valve seal, the valve remains open until the main float 42 overcomes this restriction and closes the seal onto the seat when complete flushing of the water within the tank 24 is achieved.

A pressure increasing riser 56 is positioned between the water closet 22 and the tank 24 to magnify the water pressure for flushing. While the riser 56 is basically utilized in conjunction with the dual flushing procedure it may be employed independently as a feature on other water saving devices and methods on existing toilet systems.

The riser 56 consists of a hollow pipe 58 with female threads on a first end and male threads on a second end. This pipe 58 may be metal or preferably it is made of polyvinyl chloride (PVC) Schedule 40. It is preferably 12 inches (30.5 cm) in height however, from 6 inches (15.2 cm) to 18 inches (45.7 cm) is acceptable in this application.

An attaching plate 60, having an opening therein, receives the second end of the hollow pipe 58 and contains a number of holes for connecting to commercially available water closets 22. The plate 60 may be made of any material such as plated steel, stainless steel, thermoplastic with brass being preferred. This plate 60 may be any size and shape to match specific water closet manufacturer's specifications or may be universal with extra holes added to interface with a number of different closet configurations.

A closet spud 62 threadably engages the second end of the hollow pipe 58 to retain the plate 60 inbetween and allow attachment. A resilient tapered gasket 64 is slipped over the second end of the hollow pipe 58 to hermetically seal the pipe to the water closet. A number of threaded closet fasteners 66 penetrate the holes in the plate 60 and water closet 22 compressing the gasket 64 and physically mounting the plate to the closet.

The first end of the pipe 58 is threadably screwed into the bottom portion of the dual acting closet tank flush valve 30 completing the closure and watertight seal. A decorative cover sleeve 68 is preferably placed over the pipe 58 to conceal its utilitarian appearance and add some aesthetic value to the riser. To the toilet tank 24 may also be added indicia printed on decals or nameplates that are attached onto the water tank 24, at the appropriate locations, to describe the function and indicate which lever should be used for its intended purpose.

To complete the attachment of the dual power-flush toilet 20, a tank stabilization bracket 70 is utilized that stabilizes the water tank 24 against the building wall 98. The bracket 70, as best shown in FIGS. 7 and 8, functions in combination with a toilet tank 24 as shown in FIG. 9 that includes a rear wall 25 with an upper edge 27 further having a bracket notch 29.

Figure 10:
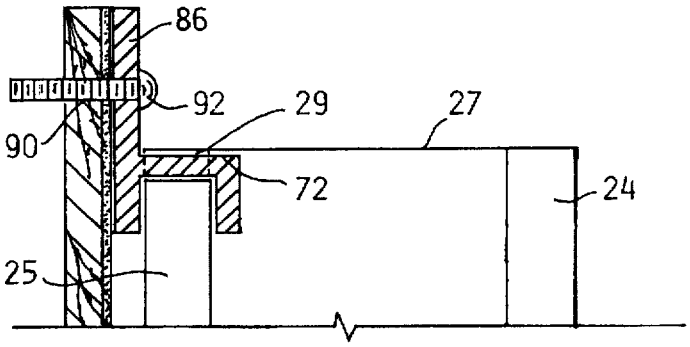
FIG. 10 is a sectional view showing the tank stabilization bracket placed over the bracket notch on the toilet tank.

The tank stabilization bracket 70 is comprised of a horizontal section 72 having a rear edge 74, a front edge 76, an upper surface 78 and a lower surface 80. From the lower surface 80 extend downward a plurality of longitudinal channels 82 that can range between two and five. The channels 82 are sized to be placed over the bracket notch 29, so that the bracket's horizontal section 72 is substantially flush with the upper edge 27 of the water tank 24 as shown in FIG. 10, thus, allowing the water tank cover (not shown) to be placed upon a planar surface. To soften the contact surface of the channel 82 with the toilet tank 25, a resilient pad 96 as shown in FIG. 7, is inserted into and attached to the particular channel 72 that is to be placed over the bracket notch 29.

Figure 7:
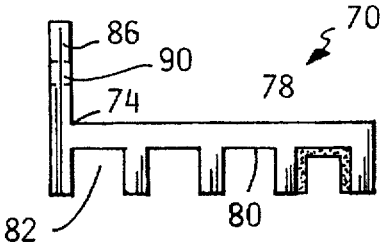
FIG. 7 is a side elevational view of a tank stabilizing bracket.
Figure 8:
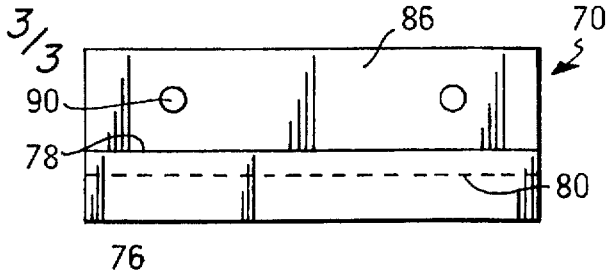
FIG. 8 is a front elevational view of the bracket.
Figure 9:
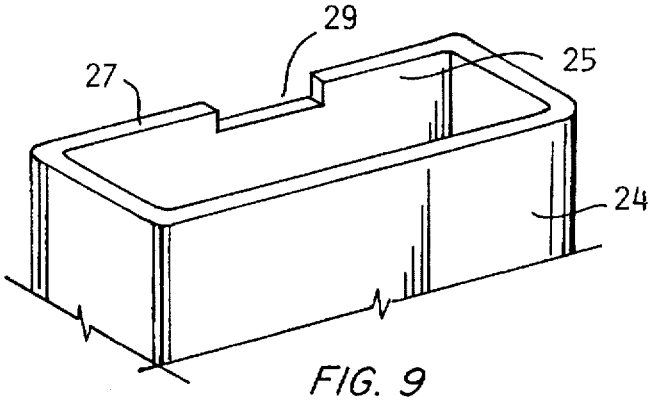
FIG. 9 is a perspective view of a toilet tank having a bracket notch cut into the edge of the rear wall.
Figure 11:
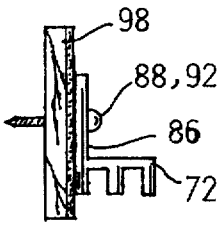
FIG. 11 is a partial elevational view showing the vertical section of the bracket attached to a wall by means of a screw.
Figure 12:
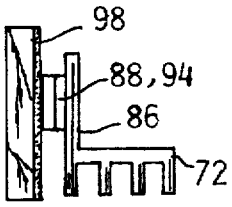
FIG. 12 is a partial elevational view showing the vertical section of the bracket attached to a wall by means of hook and loop fasteners.

Extending upward and normal from the rear edge 74 of the horizontal section 72 is a vertical section 86 as also shown best in FIGS. 7 and 8. This section has an attachment means 88 that allows it to be easily attached to a building wall 98. The attachment means 88 preferably consists of a vertical section 88 having at least two bores 90 therethrough as shown in FIG. 11. Through each of these bores 90 and into the building wall 98 is inserted a screw 92. Alternatively, as shown in FIG. 12, the attachment means 88 may consist of a hook and loop strip 94, sold under the VELCRO® trademark. In this method, a strip 94 is attached respectfully to the building wall 98 and the vertical section 86.

The process of flushing this dual flush toilet with a lessor amount of water for liquid waste and a full amount of water for solid waste comprise the steps of installing the dual acting valve 30, attaching a refill elbow 46, drilling or piercing an overflow opening 44 in the valve 30, installing a beveled washer 32 to the valve, drilling or forming a lever arm hole 52 in the tank 24, installing a second tank lever arm 50 in the hole 52 drilled in the tank 24, inserting the second tank lever arm into an existing hole in the flush valve 30 and attaching the first lever arm 28 to a flush valve float assist arm 38 beneath the second arm 50. The operation of the process has been discussed previously along with the addition of a pressure increasing riser 56 and cover sleeve 68.

The system may be provided as a kit for aftermarket usage or may be installed at the factory by the manufacturer.

While the invention has been described in complete detail and pictorially shown in the accompanying drawings it is not to be limited to such details, since many changes and modifications may be made in the invention without departing from the spirit and scope thereof. Hence, it is described to cover any and all modifications and forms which may come within the language and scope of the appended claims.

I claim:

1. A water pressure increasing riser for positioning between a toilet water closet and a water tank to increase water pressure for flushing water into said closet from said tank, said riser comprising:

a) a hollow pipe having female threads on a joint end and male threads on a second end, b) an attaching plate having an opening to receive the second end of the hollow pipe and a plurality of holes for connecting to commercially available water closets, c) a closet spud to threadably engage the second end of the hollow pipe and retain the plate therebetween, d) a resilient tapered gasket disposed upon the second end of the hollow pipe to hermetically seal the pipe to a water closet, e) a plurality of closet fasteners to affix the plate to a water closet and compress the gasket into a water closet, and f) said first end of the pipe threadably engaged into a closet tank flush valve.

2. The dual power-flush toilet as recited in claim 1 further comprising a decorative cover sleeve disposed over the pipe to conceal its appearance.

3. A dual power-flush toilet having a water closet, a water tank, closet tank ball cock and a first tank lever arm wherein the improvement comprises:

a) a dual acting closet tank flush valve including a vertical tube and an assist arm having:

(1) a water closet refill elbow attached to the vertical tube at an upper end, (2) said vertical tube having an overflow opening.and (3) a beveled washer fitted to the valve at a lower end for hermetically sealing the water tank, b) a second tank lever arm attached to the closet tank flush valve vertical tube such that manually rotating the second lever arm lifts the vertical tube causing a partial flush of water within the tank into the closet, c) said first tank lever arm attached to the closet tank flush valve float assist arm beneath the second lever arm such that manually rotating the first lever arm lifts both the vertical tube and assist arm releasing a float assist device, delaying opening of the valve until complete flushing of water within the tank is achieved, and d) a pressure increasing riser between the water closet and the water tank increasing water pressure for flushing water into the closet from the tank e) wherein said pressure increasing riser further comprises:

a hollow pipe having female threads on first end and male threads on a second end, an attaching plate having an opening to receive the second end of the hollow pipe and a plurality of holes for connection to commercially available water closets, a closet spud to threadably engage the second end of the hollow pipe and retain the plate therebetween, a resilient tapered gasket disposed upon the second end of the hollow pipe to hermetically seal the pipe to the water closet, a plurality of closet fasteners to affix the plate to the water closet and compress the gasket into the water closet and, said first end of the pipe being threadably engaged into the dual acting closet tank flush valve.

4. The dual power-flush toilet as recited in claim 1 further comprising a decorative cover sleeve disposed over the pipe to conceal its appearance.

5. The dual power-flush toilet as recited in claim 4 further comprising a tank stabilizing bracket that functions in combination with said toilet tank having a rear wall with an upper edge further having a bracket notch, said tank stabilizing bracket comprising:

a) a horizontal section having a rear edge, a front edge, an upper surface and a lower surface, with said lower surface having a plurality of longitudinal channels that are sized to be placed over said bracket notch, where when said bracket is attached, the horizontal section of said bracket is flush with the upper edge of said water tank, and b) a vertical section that extends upward and normal from the rear edge of said horizontal section, and having means for being attached to a building wall adjacent to said water tank.

6. The dual power-flush toilet as recited in claim 5 wherein said plurality of longitudinal channels ranges between two and five.

7. The dual power-flush toilet as recited in claim 6 wherein said means for attaching said vertical section to the building wall comprises:

a) said vertical section having at least two bores therethrough, and b) at least two screws that are inserted into said bores and said building wall.

8. The dual power-flush toilet as recited in claim 6 wherein said means for attaching said vertical section to the building wall comprises a hook and loop strip attached respectfully to said building wall and the vertical section of said tank stabilizing bracket.

9. The dual power-flush toilet as recited in claim 6 wherein said tank stabilizing bracket further comprises a resilient pad that is inserted into and attached to the longitudinal channel that is placed over said bracket notch.

10. A process of flushing a toilet with a lesser amount of water for liquid waste and a full amount of water for solid waste employing a toilet having a water closet, a water tank, a closet tank ball cock and a first lever arm, which comprise the steps of:

a) installing a dual acting closet tank flush valve, that includes a vertical tube and an assist arm, in a water closet, b) attaching a water closet refill elbow to the vertical tube at an upper end, c) drilling an overflow opening in the vertical tube of the flush valve, d) installing a beveled washer between the flush valve and a water closet for hermetic sealing therebetween, e) drilling a lever arm hole in a toilet water tank opposite the first lever arm in a parallel location on a reverse side, f) installing a second tank lever arm into the lever arm hole drilled in a water tank, g) inserting the second tank lever arm into an opening in the tank flush valve vertical tube such that manually rotating the second lever arm lifts the vertical tube causing a partial flush of water within a tank into a closet, and h) attaching a first tank lever arm to the flush valve float assist arm beneath the second lever arm such that manually rotating a first lever arm lifts both the vertical tube and assist arm releasing a float assist device delaying opening of the valve until complete flushing of water within a tank is achieved i) installing a pressure increasing riser, said riser comprising:

a hollow pipe having female threads on a first end and male threads on a second end, an attaching plate having an opening to receive the second end of the hollow pipe and a plurality of holes for connecting to commercially available water closets, a closet spud to threadably engage the second end of the hollow pipe and retain the plate therebetween, a resilient tapered gasket disposed upon the second end of the hollow pipe to hermetically seal the pipe to the water closet, a plurality of closet fasteners to affix the plate to the water closet and compress the gasket into the water closet and, said first end of the pipe being threadably engaged into the dual acting closet tank flush valve.

11. The process of flushing a toilet with a lesser amount of water fop liquid waste and a full amount of water for solid waste as recited in claim 10 further comprising installing a decorative cover sleeve over the pipe to conceal its appearance.

* * * * *